United States Patent [19]

Vecchiarelli

[11] 4,235,406

[45] Nov. 25, 1980

[54] SUPPORT BRACKET FOR A VENETIAN BLIND

[75] Inventor: Francis Vecchiarelli, River Edge, N.J.

[73] Assignee: Hunter Douglas International N.V., Netherlands

[21] Appl. No.: 963,132

[22] Filed: Nov. 22, 1978

[51] Int. Cl.[3] ..... A47H 1/14

[52] U.S. Cl. ..... 248/251; 160/178 R

[58] Field of Search ..... 248/251, 261, 262, 265, 248/300; 160/178 R, 178 B

[56] References Cited

U.S. PATENT DOCUMENTS

| | | | |
|---|---|---|---|
| 1,553,132 | 9/1925 | Bertrand | 248/251 |
| 1,805,611 | 5/1931 | Burns | 248/251 X |
| 1,822,890 | 9/1931 | Heymer | 248/251 X |
| 1,845,857 | 2/1932 | Ward | 248/251 X |
| 1,917,416 | 7/1933 | Zingg | 248/251 X |
| 2,367,322 | 1/1945 | Wright et al. | 248/262 |
| 2,698,727 | 1/1955 | Rutledge | 160/178 R X |
| 2,808,222 | 10/1957 | Wassyng et al. | 248/262 |
| 3,169,006 | 2/1965 | Lorentzen et al. | 248/262 |
| 4,141,525 | 2/1979 | Miller | 248/251 |

FOREIGN PATENT DOCUMENTS

| | | | |
|---|---|---|---|
| 915588 | 1/1963 | United Kingdom | 248/251 |
| 1014927 | 12/1965 | United Kingdom | 248/262 |

*Primary Examiner*—J. Franklin Foss

*Attorney, Agent, or Firm*—Pennie & Edmonds

[57] ABSTRACT

A support bracket for a venetian blind headrail, intended to be mounted intermediate the ends of the headrail, in which a rear wall has a top wall extending forwardly therefrom with a hook member at the front engageable under the front rim of the headrail. The rear of the headrail rests on a bottom wall and a downward projection from the top wall lies immediately in front of the rim of the rear flange of the headrail to prevent forward movement of the headrail, the rear surface of the projection being located rearwardly of the front of the bottom wall.

3 Claims, 3 Drawing Figures

SUPPORT BRACKET FOR A VENETIAN BLIND

BACKGROUND OF THE INVENTION

The present invention relates to a support bracket for a venetian blind.

The invention is particularly concerned with the support bracket for location at an intermediate position along the length of a venetian blind headrail. Conventionally, venetian blinds are supported at the ends and some form of bracket is also provided when the blind is of considerable length, at one or more points intermediate the end. These brackets include a vertical wall which may be secured to a wall surface, and a top wall overlies a portion of the headrail and has a hook on its front portion to hook into the rim of the front flange of the headrail. If there is any vertical play in the end supports then there is a danger of the rim jumping out of the hook accidentally when the lift cords or tilt cord is operated violently.

It is now proposed, according to the present invention, to provide a support bracket for a venetian blind headrail which is of generally channel-shaped cross-section, formed of a lower web and front and rear flanges, and having an inturned rim at the upper free edges of the front and rear flanges, said bracket comprising, in combination:

(a) a rear wall;

(b) a bottom wall extending forwardly from the rear wall;

(c) a top wall extending forwardly from the rear wall; to overlie a portion of a headrail supported on the bottom wall;

(d) a hook member at the front end of the top wall, said hook member being engageable in the rim of the front flange of the headrail; and (e) a downward projection from the top wall positioned to lie immediately in front of the rim of the rear flange of the headrail to prevent forward movement of a headrail in position on the bracket, the rear surface of the projection being located rearwardly of the front of the bottom wall.

The downward projection on the top wall, being located rearwardly of the front of the bottom wall, ensures that the headrail cannot move forward downwardly and thus become disengaged on the bracket. The projection is advantageously in the form of a tab which is punched out and bent down from the material of the top wall.

In order that the present invention may more readily be understood, the following description is given, merely by way of example, of a presently preferred mode of putting the invention into effect. The description is given with reference to the accompanying drawings.

DETAILED DESCRIPTION OF THE PREFERRED EMBODIMENT

Figure 1:
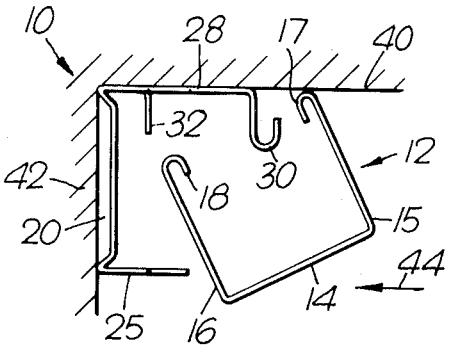
FIG. 1 is a side elevation of one embodiment of support bracket according to the invention, with a headrail being shown as it is positioned on the bracket.
Figure 2:
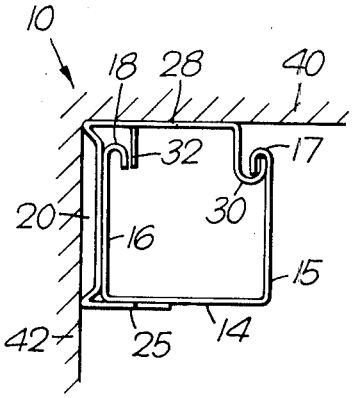
FIG. 2 is a similar view to FIG. 1 showing the head rail in position.

In FIGS. 1 and 2 there is illustrated a preferred embodiment of bracket 10 according to the invention used to support a headrail indicated by the general reference numeral 12. The headrail is of generally channel-shaped cross-section, formed of a lower web 14 and front and rear flanges 15 and 16 having inturned rims 17 and 18 at their upper free edges.

Figure 3:
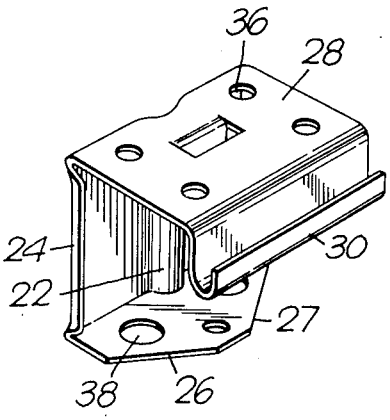
FIG. 3 is a perspective view of the bracket itself.

The bracket 10 includes a rear wall 20 having a forwardly extending central rib 22 (FIG. 3) and side wings 24 extending forwardly by the same amount as the central rib 22.

The bracket includes a forwardly extending bottom wall 25 which is cut away at the front corners 26 and 27.

Extending forwardly from the top of the rear wall is a top wall 28 having, at its front end, a hooking member 30. A downward projection in the form of a tab 32 is provided at a location spaced a short distance from the forward face of the rib 22. This tab is formed by punching out of the top wall 28. The top wall is also provided with front and rear holes 36 for the passage of screws for fixing the bracket to the ceiling. Screw holes (not shown) may be provided in the rear wall to enable the bracket to be secured to a wall surface. The large apertures in the bottom wall indicated by the reference numeral 38 are for the passage of a screwdriver for tightening the screws in the rear holes 36. Cutaway portions 26 and 27 enable the screwdriver to reach the screws of the front holes 36.

In use, the bracket is screwed to the ceiling 40 (FIG. 1) so that the rear wall 20 is against a wall surface 42. The headrail 12 is offered up in the manner indicated in FIG. 1 and the rear flange rim 18 is engaged behind the projection 32 and the headrail is then tilted forwardly and moved rearwardly as indicated by the arrow 44 until the front bead 17 engages in the hook member 30. The weight of the headrail is borne by the bottom wall 26.

Projections 32 is thus located immediately in front of the rear rim 18 and this prevents the front rim 17 from jumping out of the hook member 30 so that the rail is held reliably in place on the bracket.

I claim:

1. A support bracket for a venetian blind headrail which is of generally channel-shaped cross-section, formed of a lower web and front and rear flanges, and having an inturned rim at the upper free edges of the front and rear flanges, said bracket comprising, in combination:

(a) a rear wall;

(b) a bottom wall extending forwardly from the rear wall;

(c) a top wall extending forwardly from the rear wall to overlie a portion of a headrail supported on the bottom wall;

(d) a hook member at the front end of the top wall, said hook member being engageable in the rim of the front flange of the headrail;

(e) a downward projection from the top wall positioned to lie immediately in front of the rim of the rear flange of the headrail to prevent forward movement of a headrail in position on the bracket, the rear surface of the projection being located rearwardly of the front edge of the bottom wall; and (f) said bottom wall supporting the weight of the headrail when in use.

2. A support bracket as claimed in claim 1, or claim 3 wherein said downward projection is formed as a tab stamped out of the top wall.

3. A support bracket as claimed in claim 1, in which said bracket is free of any movable latching element.

* * * * *

UNITED STATES PATENT AND TRADEMARK OFFICE

CERTIFICATE OF CORRECTION

PATENT NO. : 4,235,406

DATED : November 25, 1980

INVENTOR(S) : Francis Vecchiarelli

It is certified that error appears in the above—identified patent and that said Letters Patent is hereby corrected as shown below:

In Item (73) Page 1, After "Netherlands" insert "Antilles"

Signed and Sealed this

*Twenty-fourth* Day of *February 1981*

[SEAL]

*Attest:*

RENE D. TEGTMEYER

*Attesting Officer*

*Acting Commissioner of Patents and Trademarks*